US010464342B1

(12) United States Patent
McConville et al.

(10) Patent No.: US 10,464,342 B1
(45) Date of Patent: Nov. 5, 2019

(54) METHOD FOR PRINTING VIEWABLE TRANSPARENT INK

(71) Applicant: Xerox Corporation, Norwalk, CT (US)

(72) Inventors: Paul J. McConville, Webster, NY (US); Dale R. Breed, Bloomfield, NY (US); Christine A. Steurrys, Williamson, NY (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 15/954,346

(22) Filed: Apr. 16, 2018

(51) Int. Cl.

| | |
|---|---|
| ***B41J 2/21*** | (2006.01) |
| ***B41M 5/00*** | (2006.01) |
| ***B41J 3/407*** | (2006.01) |
| ***B41M 7/00*** | (2006.01) |

(52) U.S. Cl.
CPC ..... *B41J 2/2114* (2013.01); *B41J 2/2135* (2013.01); *B41J 3/407* (2013.01); *B41M 5/0023* (2013.01); *B41M 5/0047* (2013.01); *B41M 5/0064* (2013.01); *B41M 7/0081* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,690,746 | B2 | 4/2010 | Mantell et al. | |
| 8,506,038 | B2 | 1/2013 | Mizes et al. | |
| 8,602,518 | B2 | 12/2013 | Mizes et al. | |
| 8,882,236 | B1 * | 11/2014 | Kroon | B41J 2/0451 347/19 |
| 9,180,712 | B1 * | 11/2015 | Stanich | B41J 29/393 |
| 2004/0135837 | A1 * | 7/2004 | Kramer | B41J 29/393 347/19 |
| 2009/0237434 | A1 * | 9/2009 | Mantell | B41J 2/2114 347/14 |
| 2011/0249051 | A1 * | 10/2011 | Chretien | B41J 2/17593 347/14 |
| 2011/0273502 | A1 * | 11/2011 | Eun | B41J 2/17593 347/14 |
| 2011/0279504 | A1 * | 11/2011 | Mizes | B41J 3/543 347/14 |
| 2012/0313989 | A1 * | 12/2012 | Mantell | B41J 2/2139 347/12 |
| 2012/0313992 | A1 * | 12/2012 | Wada | B41J 2/2114 347/15 |

(Continued)

*Primary Examiner* — Sharon A. Polk

(74) *Attorney, Agent, or Firm* — Marylou J. Lavoie, Esq. LLC

(57) ABSTRACT

A method for printing including disposing a first ink onto a substrate to form a first ink layer on the substrate in an area where a diagnostic image will be printed; disposing a second ink onto the first ink layer to form a second ink diagnostic image, wherein the first ink has a first color density and the second ink has a second color density that is different from the first ink color density, wherein the second ink drops hit and displace areas of the first ink layer creating holes which provide a density contrast; curing or drying after forming the second ink diagnostic image; wherein the second ink diagnostic image is rendered visible by the contrast between the second ink diagnostic image and the substrate as compared to the first ink layer and the substrate.

7 Claims, 3 Drawing Sheets

Comparisons of image viewed at standard viewing distance

Clear ink on transparency over manila folder

Clear ink on coated white stock

(56) References Cited

U.S. PATENT DOCUMENTS

| | | | | |
|---|---|---|---|---|
| 2013/0021398 | A1* | 1/2013 | Mizes | B41J 2/2114 347/14 |
| 2013/0293612 | A1* | 11/2013 | Smith | B41J 2/2114 347/14 |
| 2014/0139578 | A1* | 5/2014 | Mizes | B41J 3/543 347/14 |
| 2014/0139583 | A1* | 5/2014 | Kammerzell | B41J 2/2114 347/19 |
| 2014/0285558 | A1* | 9/2014 | Wada | B41M 5/00 347/14 |
| 2015/0077452 | A1* | 3/2015 | Ebisawa | B41J 2/2114 347/12 |
| 2016/0075146 | A1* | 3/2016 | Akiyama | B41J 2/2135 347/15 |
| 2017/0217160 | A1* | 8/2017 | Daniell | B41J 2/04505 |

* cited by examiner

Comparisons of image viewed at standard viewing distance
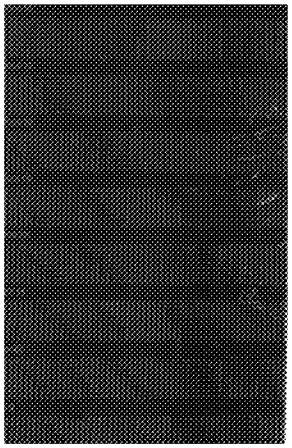
Clear ink printed within black solid on White PVC in accordance with the present embodiments
FIG. 2
Clear ink on transparency over manila folder
FIG. 3
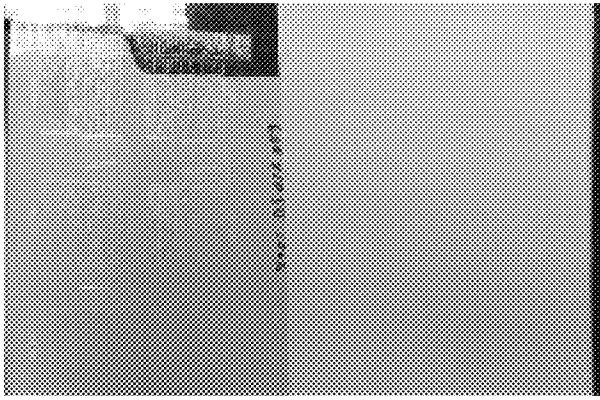
Clear ink on coated white stock
FIG. 4
Clear ink on Mylar® (reflective surface)
FIG. 5

Comparisons of image viewed under magnification using a ring light

Clear ink printed within black solid on White PVC

Clear ink on transparency over manila folder

Clear ink on coated white stock

Clear ink on Mylar® (reflective surface)

METHOD FOR PRINTING VIEWABLE TRANSPARENT INK

BACKGROUND

Disclosed herein is a method for printing and viewing transparent ink on a substrate for purposes of accessing image quality drivers, such as drop placement, either manually or automatically. The method provides the ability to detect and inspect for missing or misaligned ink jets, registration errors, and jetting quality attributes, of jets that are utilizing clear ink, without any special substrates or expensive test equipment.

More particularly disclosed is a method for printing comprising disposing a first ink onto a substrate to form a first ink layer on the substrate in an area where a diagnostic image will be printed; disposing a second ink onto the first ink layer to form a second ink diagnostic image, wherein the first ink has a first color density and the second ink has a second color density that is different from the first ink color density, wherein the second ink drops hit and displace the first ink creating density holes which provide a density contrast; curing or drying after forming the second ink diagnostic image; wherein the second ink diagnostic image is rendered visible by the contrast between the second ink diagnostic image and the substrate as compared to the first ink layer and the substrate.

Ink jet printers have print heads that operate a plurality of jets that eject liquid ink onto an image receiving member. The ink may be stored in reservoirs located within cartridges installed in the printer. Such ink may be aqueous, oil, solvent-based, or radiation (such as ultra violet or electron beam) curable ink, or an ink emulsion.

A typical full width scan inkjet printer uses one or more print heads. Each print head typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet print head, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a print head controller in accordance with image data. An inkjet printer forms a printed image in accordance with the image data by printing a pattern of individual ink drops at particular locations on the image receiving member. The locations where the ink drops land are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the print heads must be registered with reference to the imaging surface and with the other print heads in the printer. Registration of print heads is a process in which the print heads are operated to eject ink in a known pattern and then the printed image of the ejected ink is analyzed to determine the orientation of the print head with reference to the imaging surface and with reference to the other print heads in the printer. Operating the print heads in a printer to eject ink in correspondence with image data presumes that the print heads are level with a width across the image receiving member and that all of the inkjet ejectors in the print head are operational. The presumptions regarding the orientations of the print heads, however, cannot be assumed, but must be verified. Additionally, if the conditions for proper operation of the print heads cannot be verified, the analysis of the printed image should generate data that can be used either to adjust the print heads so they better conform to the presumed conditions for printing or to compensate for the deviations of the print heads form the presumed conditions.

Analysis of printed images is performed with reference to two directions. "Process direction" refers to the direction in which the image receiving member is moving as the imaging surface passes the print head to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink, and whether the ejected ink landed where the ink would have landed if the print head was oriented correctly with reference to the image receiving member and the other print heads in the printer.

Systems and methods exist for detecting ink drops ejected by different print heads, inferring the positions and orientations of the print heads, and identifying correctional data useful for moving one or more of the print heads to achieve alignment acceptable for good registration in the printing system. The ink drops are ejected in a known pattern, sometimes called a test pattern, to enable one or more processors in the printing system to analyze image data of the test pattern on the ink receiving substrate for detection of the ink drops and determination of the print head positions and orientation.

In some inkjet printing systems, print heads are configured to eject a clear ink onto the ink receiving member. This clear ink is useful for adjusting gloss levels of the final printed product and to provide a protective layer over printed areas. Clear, or transparent, ink can be used for at least two different applications in radiation curable, such as UV (ultra-violet) curable, printing systems. In one application, a clear primer is placed beneath all other images to improve adhesion of the other images to the substrate. In another application, a clear overcoat is printed on top of all of the other ink layers to add gloss and smooth image artifacts.

One issue that arises from the use of clear ink, however, is the difficulty in detecting drops of clear ink ejected onto an ink receiving member within an imaging system. Because the clear inks do not image well, the known systems and methods for aligning print heads do not enable the clear ink drops to be detected and the positions and orientations of the print heads ejecting clear ink to be inferred.

Techniques to measure ink drop placement are typically scanner based and measure the density difference of colored ink drops. With clear ink, there is no density differential to measure.

When radiation curable ink printing systems are being set up or debugged, it is important for the operator or an automatic imaging system to be able to see the clear ink. Viewing images is commonly done to ensure all jets are functional and to align the print head with respect to the printing plane as well as other print heads in the system. Prints must be viewed at angles in order to see the reflection of the clear ink. Since the operator can only see the outline of the ink at the correct angle, this method requires skill to be able to fully analyze all drops across the image. There are camera systems that can capture adequate images of clear ink with proper lighting on specialty papers, but this technology is costly and not readily available at printing sites.

U.S. Pat. No. 7,690,746, which is hereby incorporated by reference herein in its entirety, describes in the Abstract thereof a method for detecting a defect in an inkjet print head for printing a substantially clear ink includes including an ultraviolet or infrared sensitive material in the substantially clear ink, marking a test image on a substrate by jetting the substantially clear ink through one or more jets of the inkjet print head to be evaluated, exposing the test image to activating radiation having a wavelength to which the included ultraviolet or infrared sensitive material responds. During or following the exposing, the test image is evaluated with an image sensor, and whether the inkjet print head or any one of the one or more jets thereof being evaluated is defective is then determined based on the evaluation. A system for the method is also set forth.

U.S. Pat. No. 8,506,038, which is hereby incorporated by reference herein in its entirety, describes in the Abstract thereof a method that enables an operator to detect misalignment of print heads that eject clear ink in an inkjet printer. The method prints a first test pattern with a first color of ink and then prints a second test pattern of clear ink on top of the first test pattern. The ink of the first and the second test patterns is then spread to enable the clear ink to be dispersed in interstitial spaces in the ink of the first color. An operator is then able to detect the spatial relationship of predetermined marks in the second test pattern to predetermined marks in the first test pattern. The predetermined marks of the first and second test patterns are arranged to enable an operator to detect a misalignment distance and the inkjet printer uses the misalignment distance entered by the operator to adjust the alignment of the print heads that eject clear ink.

U.S. Pat. No. 8,602,518, which is hereby incorporated by reference herein in its entirety, describes in the Abstract thereof a test pattern printed by print heads in an inkjet printer enables image analysis of the test pattern that identifies positions of the print heads and the inkjets operating in the print heads. The test pattern includes a plurality of arrangements of the dashes, each arrangement of dashes having a predetermined number of rows and a predetermined number of columns, each dash in a row of dashes in the arrangement of dashes being separated by a first predetermined distance and each dash in a column of dashes in the arrangement of dashes being separated by a second predetermined distance, each dash in a column of an arrangement of dashes being ejected by a single inkjet ejector in a print head of the inkjet printer, and a plurality of unprinted areas interspersed between the plurality of arrangement of dashes.

Currently available diagnostic methods are suitable for their intended purposes. However a need remains for improved methods for viewing clear ink. Further, a need remains for an improved method for viewing clear ink disposed on a substrate without the need for complex and expensive hardware.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a method for printing comprising disposing a first ink onto a substrate to form a first ink layer on the substrate in an area where a diagnostic image will be printed; disposing a second ink onto the first ink layer to form a second ink diagnostic image, wherein the first ink has a first color density and the second ink has a second color density that is different from the first ink color density, wherein the second ink drops hit and displace the first ink creating density holes which provide a density contrast; curing or drying after forming the second ink diagnostic image; wherein the second ink diagnostic image is rendered visible by the contrast difference between the second ink diagnostic image and the substrate as compared to the first ink layer and the substrate.

Also described is a method for printing viewable transparent ink comprising disposing a dark ink onto a substrate to form a solid dark ink layer on the substrate in an area where a diagnostic image will be printed; disposing a clear ink onto the solid dark ink layer to form a clear ink diagnostic image, wherein clear ink drops hit and displace the dark ink creating clear holes which provide a density contrast; curing or drying after forming the clear ink diagnostic image; wherein the clear ink diagnostic image is rendered visible by the contrast between the clear ink diagnostic image and the substrate as compared to the dark ink layer and the substrate.

Also described is an inkjet printer comprising at least one print head having at least one inkjet from which a first ink is ejected; at least one print head having at least one inkjet from which a second ink is ejected; wherein the first ink has a first color density and the second ink has a second color density that is different from the first ink color density; a user interface through which data is entered for processing within the inkjet printer; at least one actuator operatively connected to the at least one print head that ejects the first ink; at least one actuator operatively connected to the at least one print head that ejects the second ink; at least one radiation source for curing or drying printed ink images; and a controller operatively connected to the at least one print head that ejects the first ink, the at least one print head that ejects the second ink, the at least one actuator, the at least one radiation source, and the user interface, the controller being configured: to operate the at least one print head having at least one inkjet from which the first ink is ejected to print an uncured solid first ink layer onto a substrate; to operate the at least one print head having at least one inkjet from which the second ink is ejected to print a diagnostic pattern onto the uncured solid first ink layer, such that the second ink drops hit and displace areas of the uncured solid first ink layer creating density holes which provide a density contrast; and to operate the at least one radiation source to cure or dry the printed image after the second ink diagnostic pattern is printed, wherein the second ink diagnostic pattern is rendered visible by the contrast between the second ink diagnostic pattern and the substrate as compared to undisplaced first ink layer areas and the substrate.

BRIEF DESCRIPTION OF THE DRAWINGS

FIG. 2 is an image viewed at a standard viewing distance of clear ink printed onto a black solid ink layer on a white PVC substrate in accordance with the present method.

FIG. 3 is an image viewed at a standard viewing distance of clear ink printed on a transparency which is disposed over a manila folder.

FIG. 4 is an image viewed at a standard viewing distance of clear ink printed on coated white stock.

FIG. 5 is an image viewed at a standard viewing distance of clear ink printed on a Mylar® substrate (reflective surface).

DETAILED DESCRIPTION

Figure 1:
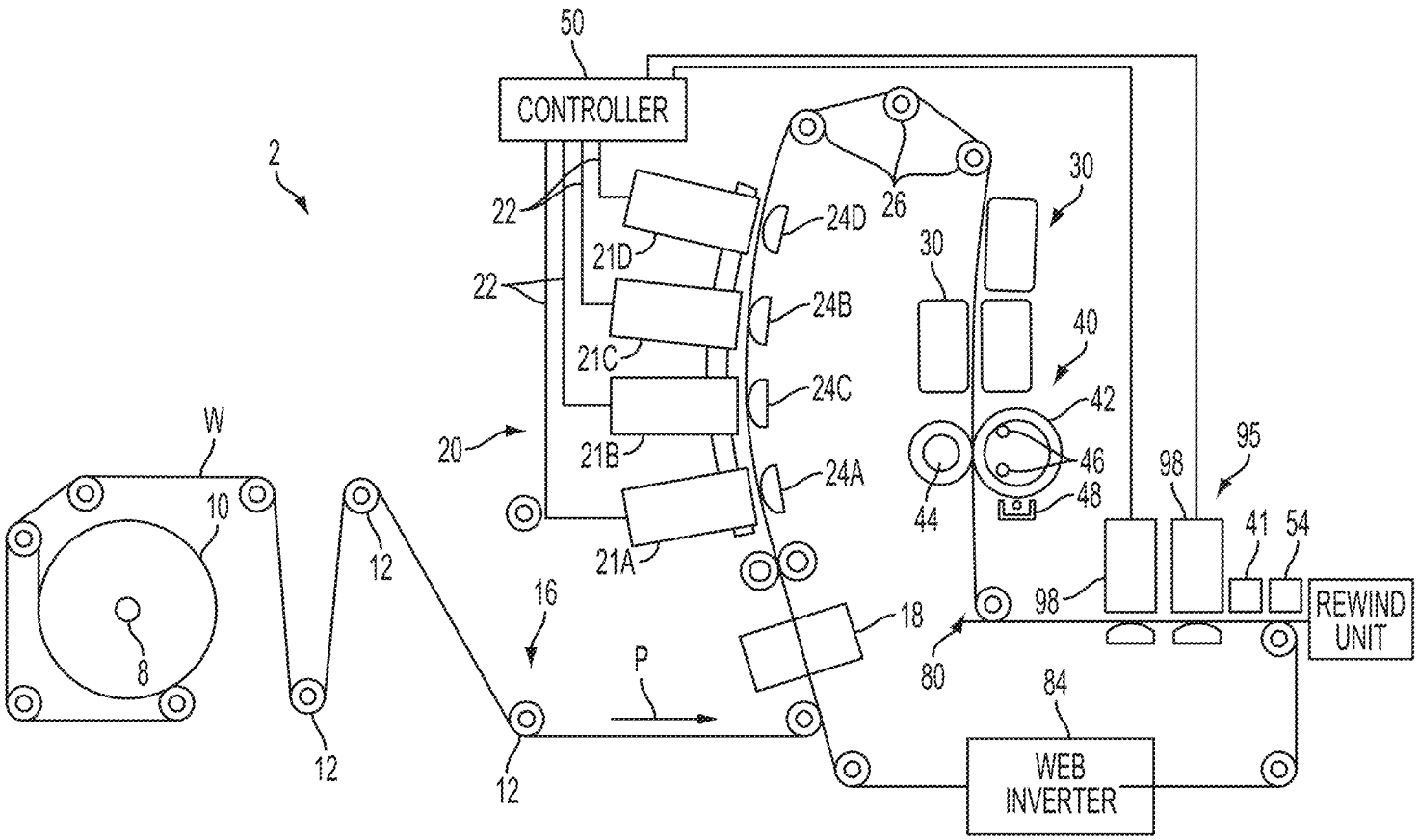
FIG. 1 is a schematic view of an inkjet imaging system that ejects ink onto a substrate as the substrate moves past the print heads in the system, which system is operated to carry out the method of the present embodiments.

Described is a method for printing comprising disposing a first ink onto a substrate to form a first ink layer on the substrate in an area where a diagnostic image will be printed; disposing a second ink onto the first ink layer to form a second ink diagnostic image, wherein the first ink has a first color density and the second ink has a second color density that is different from the first ink color density, wherein the second ink drops hit and displace areas of the first ink layer creating density holes which provide a density contrast; curing or drying after forming the second ink diagnostic image; wherein the second ink diagnostic image is rendered visible by the contrast difference between the second ink diagnostic image and the substrate as compared to the first ink layer and the substrate. In embodiments, disposing the first ink and the second ink comprises inkjet printing. In further embodiments, disposing the first ink comprises disposing two or more layers of the first ink to provide a substantially uniform solid first ink image.

The first ink layer comprising a substantially uniform film layer is smooth in appearance and substantially free of defects, such as pinholes. In embodiments, the first ink layer comprises a substantially uniform thin film layer. As used herein, a thin film layer can comprise any film layer considered to be a thin film layer as known to those of skill in the art. In embodiments, a thin film is a film having a thickness of less than about 15 micrometers. In embodiments, a thin film layer is a film having a thickness of from about 5 to about 15 micrometers, or from about 1 to less than about 10 micrometers, or from about 1 to about 5 micrometers, or from about 0.5 to about 3 micrometers, or from about 0.1 micrometer to about 1 micrometer.

A substantially uniform film layer can comprise a film layer that is the same or similar across the entirety or substantially all of the entirety of the film layer. In embodiments, a substantially uniform film layer comprises a film that has a thickness that is substantially the same across the entirety or substantially all of the entirety of the film layer. In embodiments, a substantially uniform film layer comprises a film having a smooth surface. In embodiments, a smooth surface means a rms (root mean square) surface roughness that is small compared with the wavelength of light (<lambda/10). By solid, it is meant that the layer is free of holes or gaps or at least substantially free of holes or gaps.

Also described is a method for printing viewable transparent ink comprising disposing a dark ink onto a substrate to form a solid dark ink layer on the substrate in an area where a diagnostic image will be printed; disposing a clear ink onto the solid dark ink layer to form a clear ink diagnostic image, wherein clear ink drops hit and displace the dark ink layer in areas creating clear holes which provide a density contrast; curing or drying after forming the clear ink diagnostic image; wherein the clear ink diagnostic image is rendered visible by the contrast between the clear ink diagnostic image and the substrate as compared to the dark ink layer and the substrate.

Also described is an inkjet printer comprising at least one print head having at least one inkjet from which ink having a first ink is ejected; at least one print head having at least one inkjet from which a second ink is ejected; wherein the first ink has a first color density and the second ink has a second color density that is different from the first color density; a user interface through which data is entered for processing within the inkjet printer; at least one actuator operatively connected to the at least one print head that ejects the first ink; at least one actuator operatively connected to the at least one print head that ejects the second ink; at least one radiation source for curing printed ink images; and a controller operatively connected to the at least one print head that ejects ink having the first ink, the at least one print head that ejects the second ink, the at least one actuator, the at least one radiation source, and the user interface, the controller being configured: to operate the at least one print head having at least one inkjet from which the first ink is ejected to print a solid uncured first ink layer onto a substrate; to operate the at least one print head having at least one inkjet from which the second ink is ejected to print a diagnostic pattern onto the solid uncured first ink layer, such that the second ink drops hit and displace areas of the solid uncured first ink layer creating holes which provide a density contrast; and to operate the at least one radiation source to cure or dry the printed image after the second ink diagnostic pattern is printed, wherein the second ink diagnostic pattern is rendered visible by the contrast between the second ink diagnostic pattern and the substrate as compared to undisplaced first ink layer areas and the substrate. In embodiments, the first ink is black ink and the second ink is clear.

In embodiments, a method for printing viewable transparent ink herein encompasses getting clear ink to form a contrast such that the placement of clear ink can be seen visually, that is, visual to the naked eye, and thus can be viewed by an operator without the need for costly and complex systems. The method can include disposing a uniform layer of black ink which sets the stage for dark contrast. The black ink layer is disposed at a sufficiently thin fill, wet on wet; that is, no cure, so as to form a uniform thin film. A clear ink can then be disposed on to the black ink layer. The clear ink drops hit and displace the black ink so that one is left with clear holes providing a density contrast which can be viewed by an operator or a scanner. Thus, the method provides a way to measure where the clear ink drops are; that is, a method to determine or visualize the placement of the clear ink drops which is visible to the naked eye.

The system and method can be employed with any suitable or desired set of inks, provided that the selected inks provide a sufficient contrast when used in the method so that the diagnostic pattern is rendered visible without the need for special equipment, that is, the diagnostic pattern can be seen visually. In embodiment, a first ink is selected to form a solid first ink film layer on a substrate and a second ink is selected to form a diagnostic pattern on the wet (uncured) first ink film layer. The first and second inks can be selected wherein the first ink has a first color density and the second ink has a second color density that is different from the first ink color density.

A densitometer can be used to measure the color density of an ink. Density can be expressed according to the equation $$D=\log Ii/Ir$$

wherein D is density, Ii is the Intensity of incident light, and Ir is the Intensity of reflected light. Commercially available densitometers include X-Rite 538, Pantone®.

In embodiments, the first ink has a color density of from about 0.1 to about 1.5, from about 0.6 to about 1.4, or from about 0.9 to about 1.4 and the second ink has a color density of from about 0.01 to about 0.7, from about 0.01 to about 0.3, or from about 0.01 to about 0.1. In embodiments, the difference between the first ink color density and the second ink color density is from about 1.0 to about 0.01.

As used herein, "clear ink" means any substantially clear or colorless material applied to media for any purpose, including, but not limited to, forming a protective coating on any part of an image, obtaining a desired gloss level on any part of an image, forming security marks on the media surface, pre-treating any portion of the media surface prior to printing, or acting as a primer or adhesive on the media surface for any purpose.

In embodiments, the second ink is a clear ink. In embodiments, the second ink is a clear ink that is substantially free of colorants. In embodiments, the first ink is a black in and the second ink is a clear ink.

As used herein, "dark ink" means any ink providing a sufficient contrast when displaced by the clear ink drops disposed thereon, to enable placement of the clear ink to be visible. In embodiments, the first ink is a black ink, blue ink, green ink, red ink, and combinations thereof. In embodiments, the dark ink is a black ink, a dark blue ink, dark green ink, or dark red ink.

Any suitable or desired system can be selected to effect the method herein. In embodiments, an inkjet imaging system as shown in FIG. 1 can be employed to carry out the present method. Referring to FIG. 1, an inkjet imaging system 5 is shown. The imaging apparatus is in the form of an inkjet printer that employs one or more inkjet print heads and an associated ink supply. The method herein, however, is not limited to such an apparatus, and can be carried out by any apparatus capable of disposing a first ink layer, in embodiments, a dark ink layer, such as a black ink layer, or layers, followed by disposing a second ink layer, in embodiments a clear ink layer, onto the uncured first or dark ink layer, such that the second or clear ink drops hit and displace the uncured first or dark ink so that one is left with clear holes providing a density contrast which is visible to the naked eye or can be viewed by use of a simple system such as a flatbed scanner. The method herein can also encompass manually disposing the dark ink layer or layers and clear ink drops.

Returning to FIG. 1, a controller 50 may be configured to operate print heads in the system to print a layer of dark, in embodiments, black ink, in embodiments, in a solid fill, and to print clear inks with print heads enabled to eject clear ink over the dark ink layer or layers, wet on wet, that is, without first curing the dark ink layer. As mentioned above, the method herein is applicable to any of a variety of other imaging apparatus that use inkjets to eject one or more colorants and clear ink to a medium or media. For example, while the system and method described herein are particularly directed to a direct to media printing system, the system and method may be adapted to indirect printers that form an ink image on a rotating imaging member and then transfer the ink image from the image member to media.

The imaging apparatus 5 includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants as well as clear ink to the media.

The media may include any of a variety of substrates, including plain paper, coated paper, glossy paper, transparencies, among others, and the media may be available in sheets, rolls, or other physical formats. In embodiments, the substrate is a plastic sheet, in embodiments, a polyvinyl chloride sheet.

In embodiments, any suitable substrate, recording sheet, and the like, can be employed for depositing the dark and clear ink thereon, including plain papers such as XEROX® 4024 papers, XEROX® Image Series papers, Courtland 4024 DP paper, ruled notebook paper, bond paper, silica coated papers such as Sharp Company silica coated paper, JuJo paper, HAMMERMILL LASERPRINT® paper, and the like, glossy coated papers such as XEROX® Digital Color Gloss, Sappi Warren Papers LUSTROGLOSS®, and the like, transparency materials, fabrics, textile products, plastics, polymeric films, inorganic substrates such as metals and wood, as well as meltable or dissolvable substrates, such as waxes or salts and the like. In embodiments, the substrate is selected from the group consisting of plain paper, bond paper, silica coated paper, glossy coated paper, transparency material, plastic, polymeric film, metal, wood, wax, and salt.

The substrate can be any suitable or desired color. In embodiments, the substrate is clear, white, or a light shade. In certain embodiments, the substrate is white. In certain other embodiments, the substrate is plastic, in embodiments, a white plastic. In certain specific embodiments, the substrate is a polyvinyl chloride.

Direct-to-sheet, continuous-media, phase change inkjet imaging system 5 includes a media supply and handling system configured to supply a long (i.e., substantially continuous) web of media W of "substrate" (paper, plastic or other printable material from a media source, such as a spool of media 10 mounted on a web roller 8. For simplex printing, the printed is comprise of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95, before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 and downstream rollers 26 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and numbers of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 21D, each color unit effectively extending across the width of the media and being able to place ink directly (that is, without use of an intermediate or offset member) onto the moving media. As is generally familiar, each of the print heads may eject a single color of ink, one for each of the colors typically used in color printing, namely, cyan, magenta, yellow, and black (CMYK).

In the system shown in FIG. 1, a coating station 95 that ejects clear ink follows the color unit that ejects black ink in the process direction. The coating station 95 applies a clear ink to the printed media. This clear ink helps protect the printed media from smearing or other environmental degradation following removal from the printer. The overlay of clear ink can act as a sacrificial layer of ink that may be smeared and/or offset during handling without affecting the appearance of the image underneath. The coating station 95 ejects clear ink from a print head 98 in a pattern.

In embodiments, clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises an ink formulation without colorant, in embodiments a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain polyethylene or polymethylene waxes. Similar to the colored phase change inks, clear phase change ink is substantially solid at room temperature and substantially liquid or melted when initially jetted onto media. The clear phase change ink may be heated to a temperature of from about 100° C. to about 140° C. to melt the solid ink for jetting on to the media.

The controller 50 of the printing system 5 receives velocity data from encoders mounted proximately to rollers positioned on either side of the portion of the path opposite the four color units and the coating station to calculate the linear velocity and position of the web as it moves past the print heads. The controller 50 uses these data to generate timing signals for actuating the inkjet ejectors in the print heads to enable the four colors to be ejected with a reliable degree of accuracy for registration of the differently colored patterns to form four primary-color images on the media. The inkjet ejectors actuated by the firing signals correspond to image data processed by the controller 50. The image data may be transmitted to the printer, generated by a scanner (not shown) that is a component of the printer, or otherwise generated and delivered to the printer. In various possible embodiments, a color unit for each primary color and the coating station may include one or more print heads, multiple print heads in a color unit may be formed into a single row or multiple row array, print heads of a multiple row array may be staggered, a print head may print more than one color, or the print heads or portions of a color unit may be mounted movably in a direction transverse to the process direction P, such as for spot-color applications, and the like.

Each of color units 21A-21D and the coating station 95 includes at least one actuator configured to adjust the print heads in each of the print head modules in the cross-process direction across the media web. In a typical embodiment, each motor is an electromechanical device such as a stepper motor or the like. In a practical embodiment, a print bar actuator is connected to a print bar containing two or more print heads. The print bar actuator is configured to reposition the print bar by sliding the print bar along the cross-process axis of the media web. Print head actuators may also be connected to individual print heads within each of color units 21A-21D and the coating station 95. These print head actuators are configured to reposition an individual print head by sliding the print head along the cross-process axis of the media web. In this embodiment, the print head actuators are devices that physically move the print heads in the cross-process direction. In alternative embodiments, an actuator system may be used that does not physically move the print heads, but redirects the image data to different ejectors in each head to change head position. Such an actuator system, however, can only reposition the print head in increments that correspond to ejector to ejector spacing in the cross-process direction.

The printer may use phase change ink, by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is from about 70° C. to about 140° C. In other embodiments, the ink utilized in the imagining device may comprise UV curable gel ink. Gel ink may also be heated before being ejected by the inkjet ejectors of the print head. As used herein, liquid ink refers to melted solid ink, heated gel ink, or other known forms of ink, such as aqueous inks, ink emulsions, ink suspensions, ink solutions, or the like. In certain embodiments, the inks selected for the present embodiments comprise liquid inks such as aqueous inks, ink emulsions, ink suspensions, ink solutions, or the like. Certain heaters, rollers, and the like, suitable for phase change ink type systems will not be required for liquid ink systems.

Associated with each color unit and the coating station is a backing member 24A-24D, typically in the form of a bar or roll, which is arranged substantially opposite the color unit on the back side of the media. Each backing member is used to position the media at a predetermined distance from the print heads opposite the backing member. Each backing member may be configured to emit thermal energy to heat the media to a predetermined temperature which, in one practical embodiment, is in a range of from about 40° C. to about 60° C. The various backer members may be controlled individually or collectively. The pre-heater 18, the print heads, backing members 24 (if heated), as well as the surrounding air combine to maintain the media along the portion of the path opposite the printing station 20 in a predetermined temperature range, such as from about 40° C. to about 70° C.

As the partially imaged media moves to receive inks of various colors from the print heads of the color units, the temperature of the media is maintained within a given range. Ink is ejected from the print heads at a temperature typically significantly higher than the receiving media temperature. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the print heads of the color units. Temperature sensors (not shown) may be positioned along this portion of the media path to enable regulation of the media temperature. These temperature data may also be used by systems for measuring or inferring (from the image data, for example) how much ink of a given primary color from a print head is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader or fixing assembly 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures, such as to a temperature of from about −10° C. to about 20 above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. A function of the fixing assembly 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roller can include heat elements, such as heating elements 46, to bring the web W to a desired temperature, such as to a temperature in the range of from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like. When the printer is in the mode to print the test image, the dark ink must remain liquid until the clear ink is laid down. Therefore, in embodiments, rollers and heating elements, such as image-side roller 42, pressure roller 44, and heating elements 46 are non-contact and/or are disengaged while the printer is operated in test mode. In embodiments, the fixing assembly 40 may comprise a radiation source for curing printed ink images. Alternately, a separate radiation source may be provided. In the present method, the fixing assembly 40, or a separate curing unit, can be employed to cure the image after the second, diagnostic image is printed. In embodiments, fixing unit 41 is disposed after the clear print head for fixing, such as heating or curing, in embodiments, radiation curing, after the clear ink is disposed. Optical imaging device 54 can be disposed after the fixing unit 41. Thus, the curing unit can be disposed after the coating station 95 or the substrate can be returned through the fixing assembly 40 equipped with the curing device to cure the image after the second diagnostic image is disposed over the first uncured solid image fill.

In embodiments, the method herein is carried out using a single platen that moves the substrate back and forth in front of the various print heads including the dark ink print head and the clear ink print head and then on to the curing and/or heating lamp after the clear ink is disposed. In this fashion, multiple passes of the substrate past the dark ink print head is accomplished.

In embodiments, inks used for the processes herein are curable inks, in embodiments, radiation curable. The term "radiation curable" is intended to cover all forms of curing upon exposure to a radiation source, including light, heat, and electron sources and including in the presence or absence of initiators. Radiation curing routes include, but are not limited to, curing using ultraviolet (UV) light, for example having a wavelength of about 200 to about 400 nanometers or more rarely visible light, such as in the presence of photoinitiators and/or sensitizers, curing using e-beam radiation, such as in the absence of photoinitiators, curing using thermal curing, in the presence or absence of high temperature thermal initiators (and which are generally largely inactive at the jetting temperature), and appropriate combinations thereof. In specific embodiments, curing herein comprises thermal curing or ultra-violet curing.

In embodiments, curing of the ink can be effected by exposure of the ink image to actinic radiation at any desired or effective wavelength, in one embodiment at least about 200 nanometers, and one embodiment no more than about 480 nanometers, although the wavelength can be outside of these ranges. Exposure to actinic radiation can be for any desired or effective period of time, in one embodiment for at least about 0.2 second, in another embodiment for at least about 1 second, and in yet another embodiment for at least about 5 seconds, and in one embodiment for no more than about 30 seconds, and in another embodiment for no more than about 15 seconds, although the exposure period can be outside of these ranges. In embodiments, by curing it is meant that the curable compounds in the ink undergo an increase in molecular weight upon exposure to actinic radiation, such as (but not limited to) crosslinking, chain lengthening, or the like.

In one practical embodiment, the roller temperature in spreader 40 is maintained at a temperature to an optimum temperature that depends on the properties of the ink, in embodiments such as 55° C. Generally, a lower roller temperature gives less line spread while a higher temperature causes imperfections in the gloss. Roller temperatures that are too high may cause ink to offset to the roll. In one practical embodiment, the nip pressure is set in a range of from about 500 to about 2,000 psi (pounds per square inch). Lower nip pressure gives less line spread while higher pressure may reduce pressure roller life.

The spreader 40 may also include a cleaning/oiling station 48 associated with image-side roller 42. The station 48 cleans and/or applies a layer of a release agent or other material to the roller surface. The release agent material may be an amino silicone oil having a viscosity of about 10 to about 200 centipoises. Only small amounts of oil are required and the oil carried by the media is only about 1 to 10 mg per A4 size page. In one possible embodiment, the mid-heater 30 and spreader 40 may be combined into a single unit, with their respective functions occurring relative to the same portion of media simultaneously. In another embodiment, the media is maintained at a high temperature as it is printed to enable spreading of the ink.

Following passage through the spreader 40 the printed media may be wound onto a roller for removal from the system (simplex printing) or directed to the web inverter 84 for inversion and displacement to another section of the rollers for a second pass by the print heads, mid-heaters, spreader, curing station, and coating station. The duplex printed material may then be wound onto a roller for removal from the system by rewind unit 90. Alternatively, the media may be directed to other processing stations that perform tasks, such as cutting, binding, collating, and/or stapling the media, or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the processes for identifying malfunctioning inkjets and operating neighboring inkjets to compensate for the loss of the malfunctioning inkjets. These components may be provided on a printed circuit card or provided as a circuit in an application specific integrated circuit (ASIC). Each of the circuits may be implemented with a separate processor or multiple circuits may be implemented with discrete components or circuits provided in very large scale integration (VLSI) circuits. Also, the circuits described herein may be implemented with a combination of processors, ASICs, discrete components, or VLSI circuits. Controller 50 may be operatively coupled, illustrated as lines 22, to the print bar and print head actuators of color units 21A-21D and coating station 95 in order to adjust the position of the print bars and print heads in the cross-process direction.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the print head assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDs may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array extends substantially across the width of the age receiving member. Alternatively, a shorter linear array may be configured to translate across the image substrate. For example, the linear array may be mounted to a movable carriage that translates across the image receiving member. Other devices for moving the light sensor may also be used.

In embodiments of the present method, a solid layer of black ink is printed onto a substrate, in embodiments using a printer system such as described above, in embodiments, the black ink is printed onto a white substrate. The substrate can be selected to have the proper surface energy to allow the black ink to spread and achieve a solid fill. Any suitable or desired substrate can be selected. In embodiments, a PVC (polyvinyl chloride) substrate is selected. While the black ink remains fluid, a test pattern of clear ink is jetted onto the black ink layer. As the clear ink lands on the substrate, the clear ink has enough velocity to force the black ink to move aside. The image is cured before the clear ink has time to mix with the black ink. When viewing the print, either by an operator viewing visually or with a camera, the clear ink is still not visible, but the substrate behind the clear ink is visible. Thus, one can easily see where the clear ink has landed. Thus, a quick, easy, and inexpensive method for viewing clear ink is provided without the need for special equipment. The method enables an operator to easily view the location of clear ink without the use of special dyes in the clear ink and without the use of special imaging equipment.

The images can be viewed from any suitable or desired distance, or scanned and viewed on a computer monitor by an operator or evaluated by a computer software program. FIGS. 2-5 provide comparisons of images viewed at a standard viewing distance, which can mean, in embodiments, at a distance of from about 6 inches to about 2 feet, or from about 12 inches to about 2 feet, or other suitable distance.

FIG. 2 is an image viewed at a standard viewing distance of clear ink printed onto a black solid ink layer on a white PVC substrate in accordance with the present method.

FIG. 3 is an image viewed at a standard viewing distance of clear ink printed on a transparency which is disposed over a manila folder.

FIG. 4 is an image viewed at a standard viewing distance of clear ink printed on coated white stock.

FIG. 5 is an image viewed at a standard viewing distance of clear ink printed on a Mylar® substrate (reflective surface).

FIGS. 6-9 provide comparisons of images viewed under magnification using a ring light.

Figure 6:
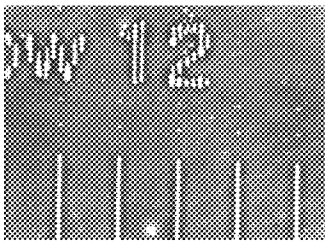
FIG. 6 is an image viewed under magnification using a ring light of clear ink printed onto a black solid layer on a white PVC substrate.

FIG. 6 is an image viewed under magnification using a ring light of clear ink printed onto a black solid layer on a white PVC substrate.

Figure 7:
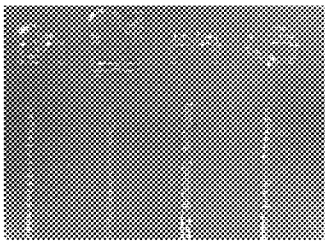
FIG. 7 is an image viewed under magnification using a ring light of clear ink printed on a transparency which is disposed over a manila folder.

FIG. 7 is an image viewed under magnification using a ring light of clear ink printed on a transparency which is disposed over a manila folder.

Figure 8:
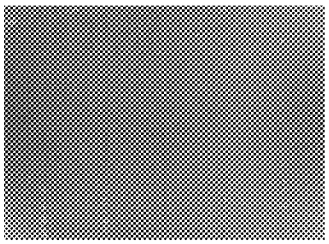
FIG. 8 is an image viewed under magnification using a ring light of clear ink printed on coated white stock.

FIG. 8 is an image viewed under magnification using a ring light of clear ink printed on coated white stock.

Figure 9:
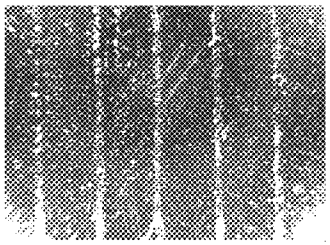
FIG. 9 is an image viewed under magnification using a ring light of clear ink printed on a Mylar® substrate (reflective surface).

FIG. 9 is an image viewed under magnification using a ring light of clear ink printed on a Mylar® substrate (reflective surface).

In embodiments, the method herein comprises the following steps.

1. An operator requests that the printing apparatus print a diagnostic target or run a diagnostic routine.

2. The operator loads a substrate, in embodiments, a white plastic sheet, into the system. The substrate is selected in accordance with the ink formulations.

3. A solid black image is printed in the area where the diagnostic image will print. Several passes may be made past the print head in order to achieve a uniform black layer.

4. The requested diagnostic target is printed using clear ink which is disposed on top of the black area.

5. The platen then passes by the UV lamp for a complete cure cycle to lock all of the ink in place.

6. The image may then be viewed by an operator or any automatic imaging system including an inexpensive flatbed scanner.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A method for printing viewable transparent ink comprising:

disposing a dark ink onto a substrate to form a solid dark ink layer on the substrate in an area where a diagnostic image will be printed;

disposing a clear ink onto the solid dark ink layer to form a clear ink diagnostic image, wherein clear ink drops hit and displace the dark ink creating clear holes which provide a density contrast;

curing or drying after forming the clear ink diagnostic image;

wherein the clear ink diagnostic image is rendered visible by the contrast between the clear ink diagnostic image and the substrate as compared to the dark ink layer and the substrate.

2. The method of claim 1, wherein the dark ink is selected from the group consisting of black ink, blue ink, green ink, red ink, and combinations thereof.

3. The method of claim 1, wherein the dark ink is black ink.

4. The method of claim 1, wherein the clear ink is substantially free of colorant.

5. The method of claim 1, wherein disposing the dark ink and disposing the clear ink comprises inkjet printing.

6. The method of claim 1, wherein disposing the solid dark ink comprises disposing two or more layers of dark ink to provide a substantially uniform solid dark ink layer.

7. The method of claim 1, wherein the substrate is a white plastic.

* * * * *